US007193491B2

(12) United States Patent
Leadley-Brown et al.

(10) Patent No.: US 7,193,491 B2
(45) Date of Patent: Mar. 20, 2007

(54) MULTI-PLANAR SEALING GASKET FOR WAVEGUIDE ASSEMBLY

(75) Inventors: Max Leadley-Brown, Edinburgh (GB); Ian Grant, Edinburgh (GB); Stephen Buchan, Perth (GB)

(73) Assignee: Andrew Corporation, Westchester, IL (US)

( * ) Notice: Subject to any disclaimer, the term of this patent is extended or adjusted under 35 U.S.C. 154(b) by 36 days.

(21) Appl. No.: 10/907,164

(22) Filed: Mar. 23, 2005

(65) Prior Publication Data

US 2006/0214751 A1 Sep. 28, 2006

(51) Int. Cl.
*H01P 1/04* (2006.01)

(52) U.S. Cl. ..... 333/254; 277/603; 277/641

(58) Field of Classification Search ..... 277/602, 277/603, 608, 641; 174/366, 367, 370; 333/254, 333/248

See application file for complete search history.

(56) References Cited

U.S. PATENT DOCUMENTS

| | | | | |
|---|---|---|---|---|
| 3,201,725 | A | 8/1965 | Johnson | |
| 6,608,251 | B1 * | 8/2003 | Nurmi | 174/367 |
| 2002/0144392 | A1 | 10/2002 | John et al. | |
| 2004/0063234 | A1 | 4/2004 | Takase et al. | |

FOREIGN PATENT DOCUMENTS

| | | |
|---|---|---|
| JP | 63013501 | 1/1988 |

* cited by examiner

*Primary Examiner*—Benny Lee
(74) *Attorney, Agent, or Firm*—Babcock IP, PLLC

(57) ABSTRACT

A sealing gasket for a waveguide assembly having a primary sealing surface loop defining a first plane and at least one secondary loop defining a second plane. The primary sealing surface loop intersecting with and being broken by the at least one secondary loop at two locations around the secondary loop.

9 Claims, 5 Drawing Sheets

MULTI-PLANAR SEALING GASKET FOR WAVEGUIDE ASSEMBLY

BACKGROUND

Microwave components such as waveguide diplexer assemblies are typically formed by machining complementary pairs of cavity networks in two halves. The two halves mate together along a first planar surface to form the desired waveguide, filter and mixing passages. Input and output waveguide ports are provided in planar port surfaces typically normal to and each bisected by the first planar surface.

To environmentally seal the waveguide assembly, a sealing gasket is required along the first planar surface and also around each of the input and output ports. Because the first planar surface bisects each of the input and or output ports a small gap exists between a sealing gasket applied to the first planar surface and each intersection with separate input and or output port sealing gasket(s).

Previously, unitary sealing gaskets for multiple planar surfaces have applied foldable portions containing a secondary gasket surface that may be folded to align with a different planar sealing surface, the circumference of the seal formed not intersecting the primary surface. Also, a sealing gasket such as an o-ring may be turned upon itself to form two or more sealing loops each of which may be aligned with a desired planar sealing surface. However, this solution also fails where one sealing surface must intersect another. Further, a small gap is created at each sealing loop intersection as the gasket crosses itself. Alternatively, liquid or semi-liquid sealing material caulks such as silicone or the like may be manually applied to a sealing groove that then forms a single use gasket upon hardening. Each of the prior solutions either fails to completely seal the assembly, is inapplicable to the intersecting sealing planes of a waveguide assembly and or requires an undesirably high level of installation skill, time and or cost.

The increasing competition for microwave assemblies has focused attention on cost reductions resulting from increased materials, manufacturing and service efficiencies. Further, reductions in required assembly operations and the total number of discrete parts are desired.

Therefore, it is an object of the invention to provide an apparatus that overcomes deficiencies in the prior art.

BRIEF DESCRIPTION OF THE DRAWINGS

The accompanying drawings, which are incorporated in and constitute a part of this specification, illustrate embodiments of the invention and, together with the general and detailed descriptions of the invention appearing herein, serve to explain the principles of the invention.

DETAILED DESCRIPTION

Figure 1:
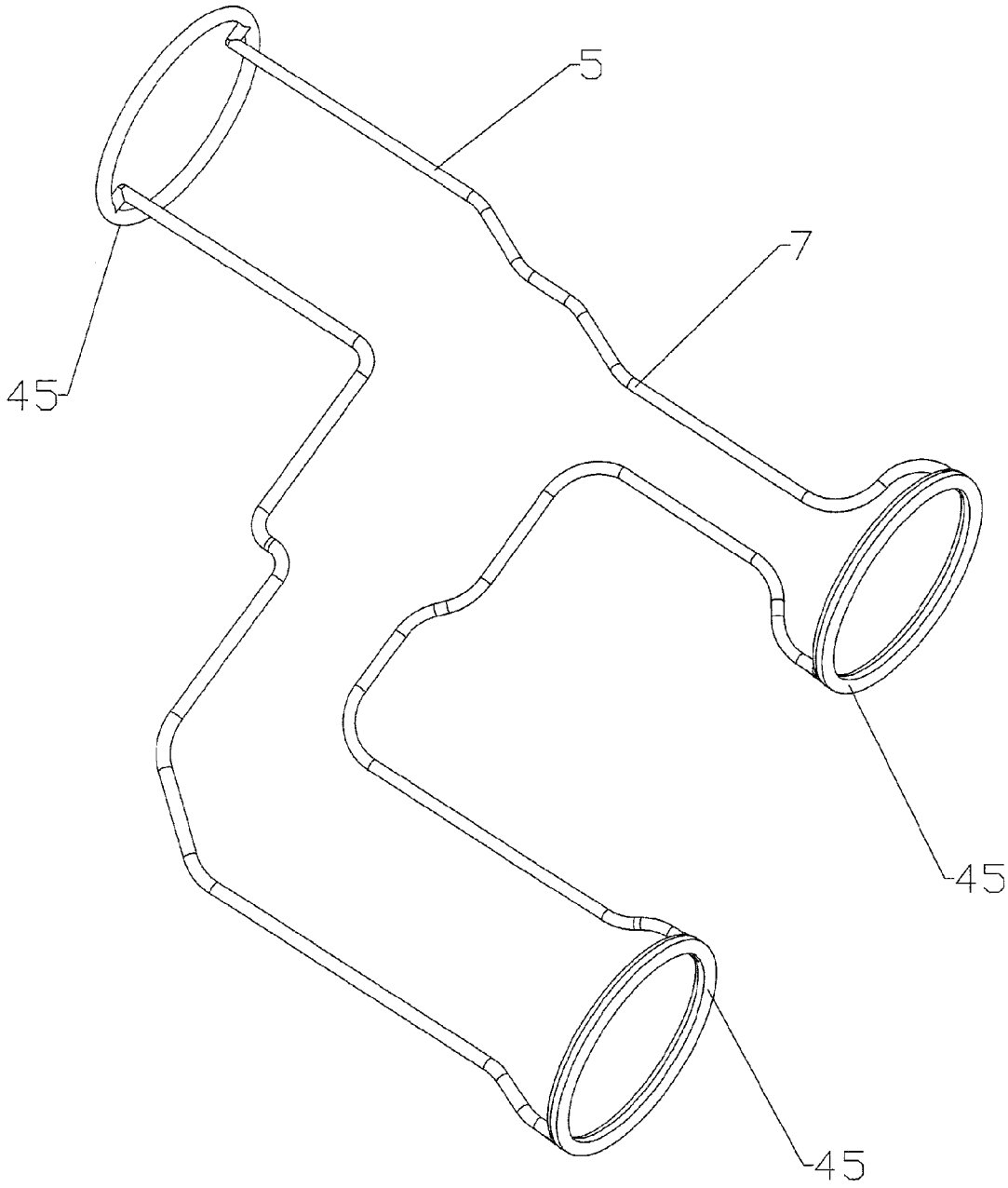
FIG. 1 is a schematic isometric view of a first exemplary embodiment of a sealing gasket according to the invention.
Figure 2:
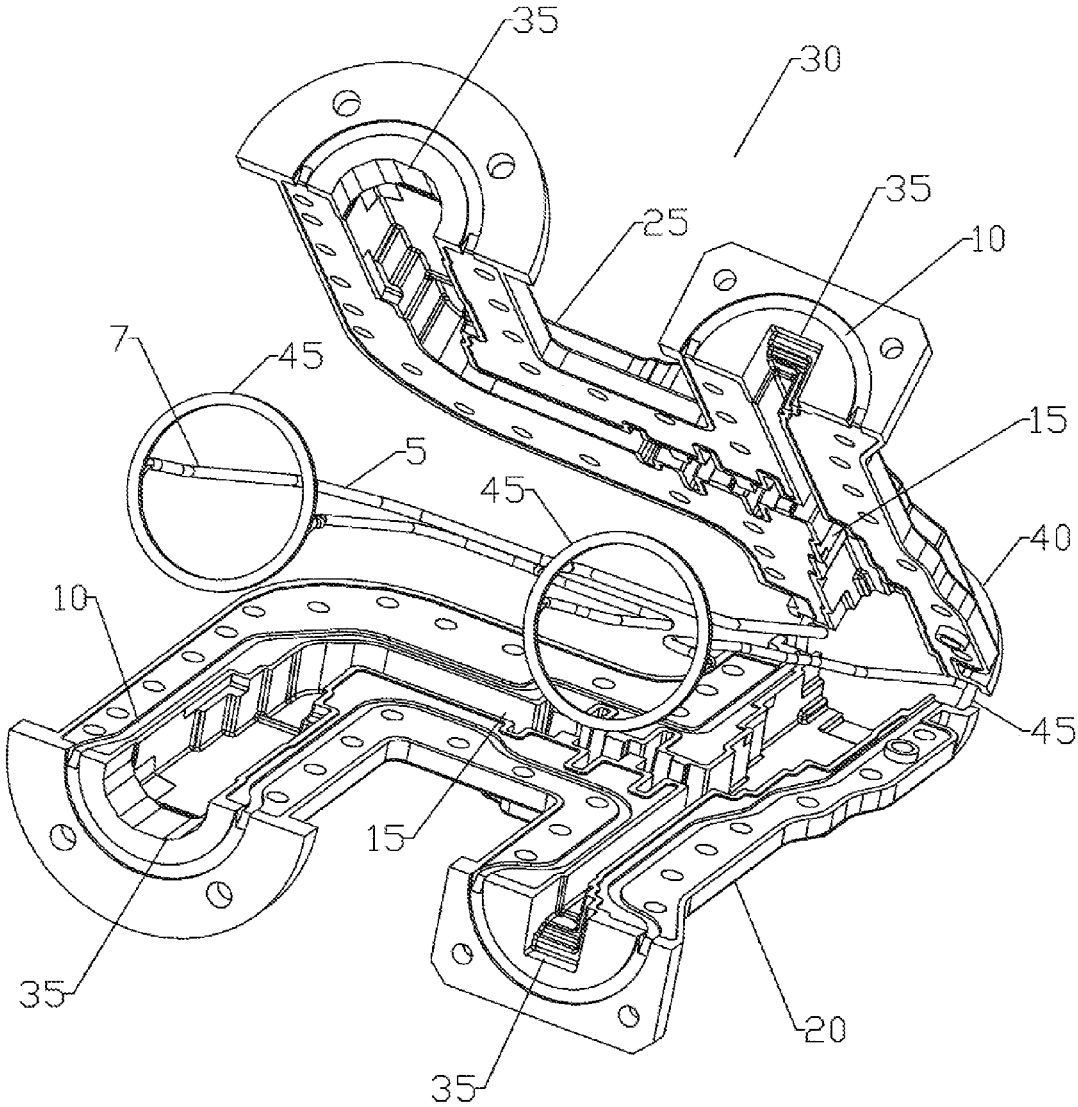
FIG. 2 is an exploded schematic isometric section view of the sealing gasket of FIG. 1 with a corresponding waveguide assembly.

According to the invention, a single unitary sealing gasket is adapted for sealing along a first plane and one or more different planar surfaces that are, for example, bisected by the first plane. Because the resulting sealing gasket is unitary, there are no gaps formed between the sealing surfaces of the first plane and the one or more different planar surfaces.

The sealing gasket may be cost effectively manufactured, for example, by injection molding of liquid and or semi-liquid materials such as rubber, acrylic, silicone, epdm (ethylene propylene diene monomer), nitrile (ASTM D 2000-M1BG 407, 507, 610, 710, 810, 910) or the like into multiple dies adapted to mate together to form a three dimensional mold. Multiple die three dimensional injection molding technology is well known and is therefore not further described herein in greater detail. The cost increase resulting from production and application of the more than two dies necessary to form the three dimensional structure of the sealing gasket is overcome by the improved sealing performance and or installation inefficiencies related to alternative sealing gasket solutions.

As shown in FIGS. 1–4, where like features in the different drawing figures are denoted by the same reference numbers, a first exemplary embodiment of a sealing gasket 5 according to the invention is adapted to seal a primary sealing surface loop 7 that defines a first plane. The primary sealing surface loop is adapted to mate with a sealing groove 10 routed around waveguide feature(s) 15 formed in complementary first and or second portion(s) 20, 25 of a waveguide assembly 30. Two input port(s) 35 coupled to the waveguide feature(s) 15 are positioned in a second plane defined by the end cross section of each input port 35. An output port 40 coupled to the waveguide feature(s) 15 is positioned in a third plane defined by an end cross section of the output port 40. The sealing gasket 5 enters the second and third planes and transitions into secondary loop(s) 45 adapted to mate with sealing groove(s) 10 looping around each input and output port 35, 40 that are bisected at two locations by the first plane.

In the present embodiment, the second and third planes are aligned normal to the first plane. In alternative configurations, the ports and associated secondary loop(s) 45 may be at any desired angle of alignment with each other according to the requirements of waveguide feature(s) 15 and or the desired port interconnection orientations.

As shown, the sealing groove(s) 10 are formed along the primary sealing surface loop 7 in the first portion 20. Alternatively, the sealing groove(s) 10 along the first plane may be formed in both the first and second portion(s) 20, 25.

Figure 3:
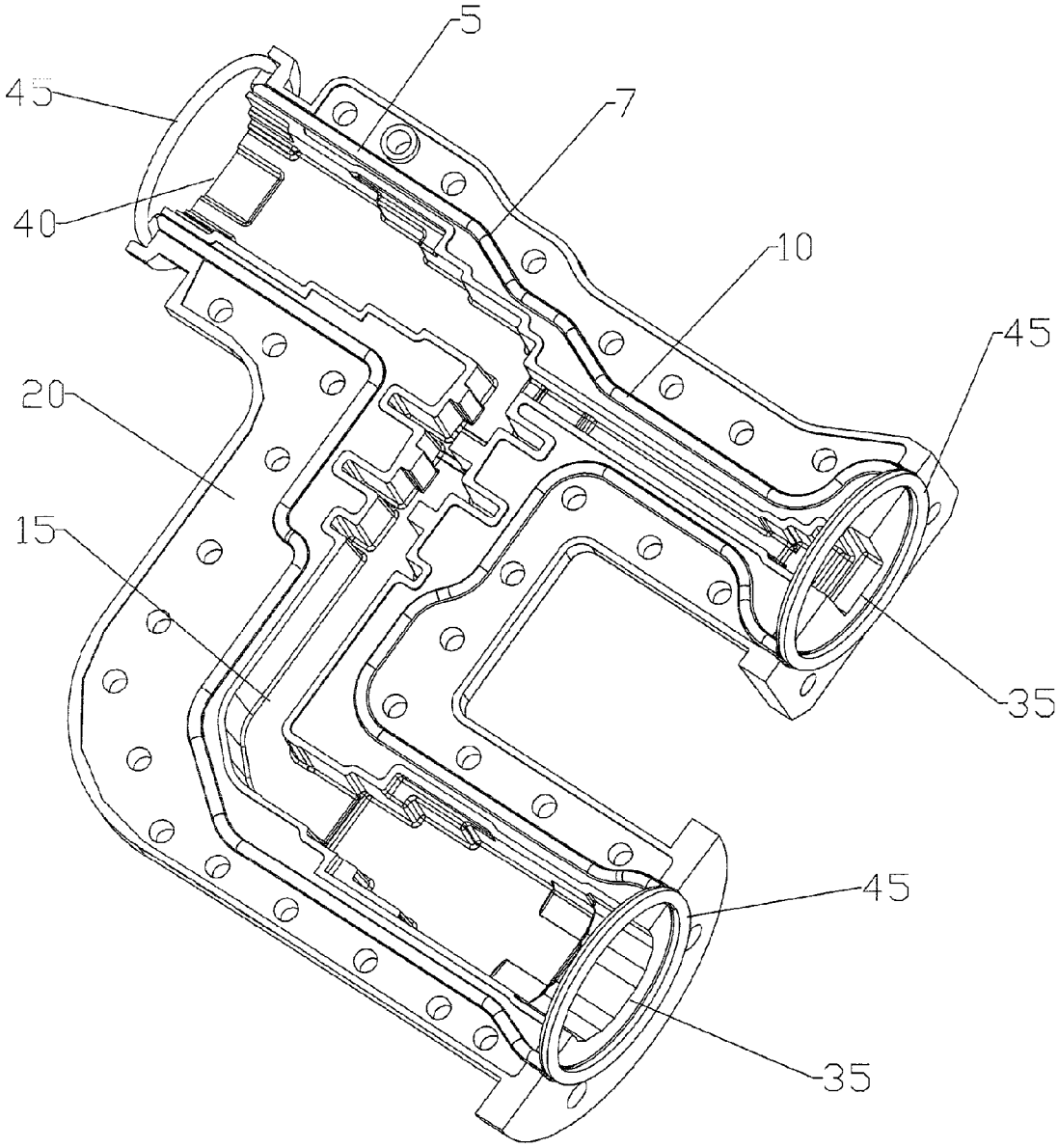
FIG. 3 is a schematic isometric view of the sealing gasket of FIG. 1, installed in a first half of the waveguide assembly of FIG. 2.

The intersection of the sealing gasket 5 along the primary surface sealing loop of the first plane with the secondary loop (s) of the sealing gasket 5 secondary loop(s) 45 around the input and output port(s) 35, 40 in the second and third planes may be formed as a straight-on connection to the secondary loop(s) 45 as shown for in FIG. 3 with respect to the input port(s) 35. Alternatively, the intersection may be adapted to enter the plane of the input and or output port 35, 40, within the area surrounded by the secondary loop 45, and then connect to the secondary loop 45 from a direction parallel to the plane, as shown for example with respect to the output port 40. This arrangement is useful for configurations where minimized port dimensions are desired, for example where the port attachment is via a surrounding outer clamp.

Figure 4:
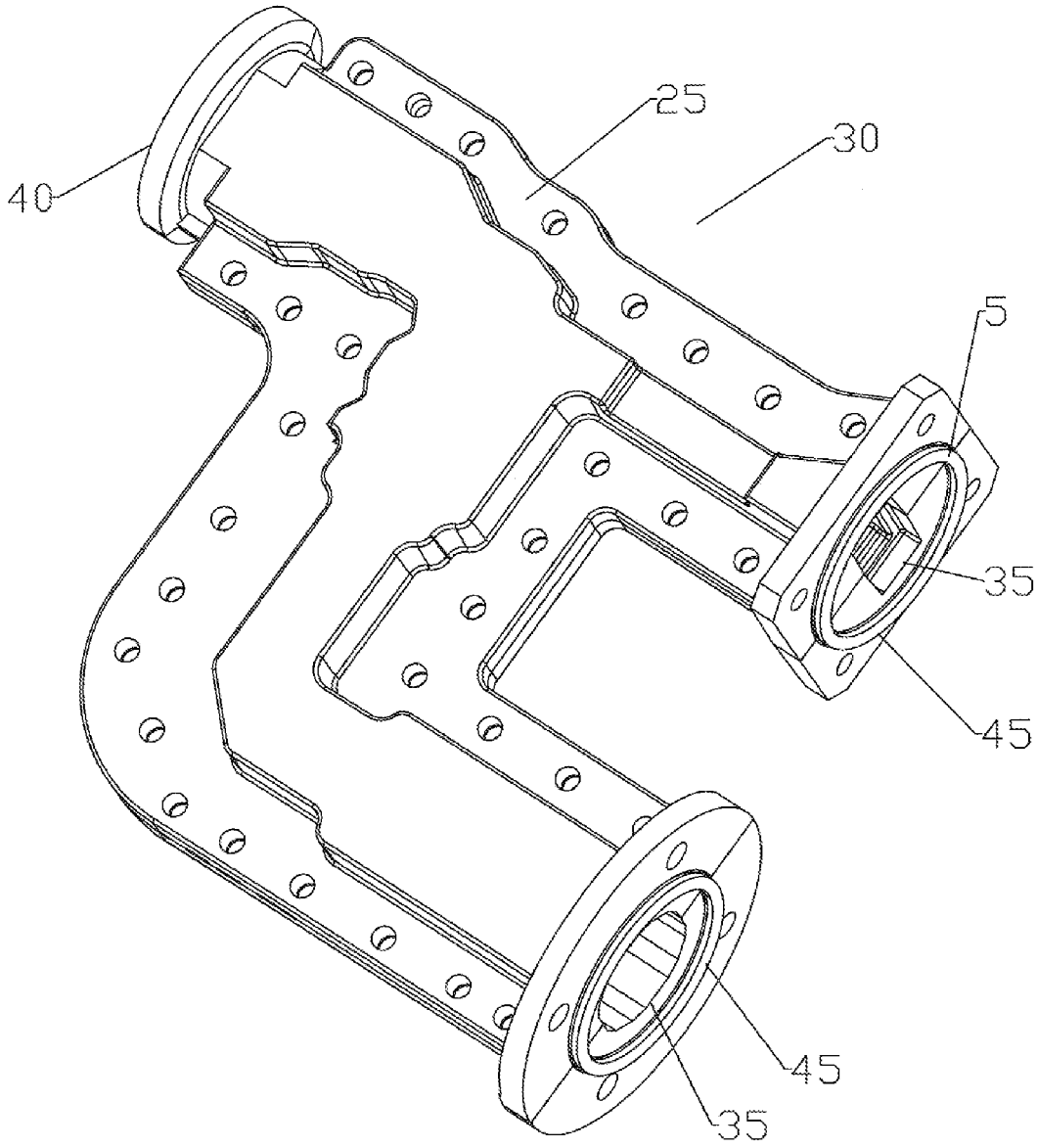
FIG. 4 is a schematic exterior isometric view of the sealing gasket of FIG. 1, installed in the waveguide assembly of FIG. 2.

In use, the sealing gasket 5 may be first aligned along the first plane in the sealing groove(s) of the first portion 20, as shown in FIG. 3. Then, as shown in FIG. 4, the second portion 25 of the waveguide assembly 30 is mated to the first portion 20 of the waveguide assembly 30, sandwiching the sealing gasket 5 along the first plane between them. As the first and second portion(s) 20, 25 are drawn together, care is taken to align the secondary loon(s) 45 of the sealing gasket 5 in the second and third planes with respective sealing groove(s) 10 around each input and output port 35, 40.

Figure 5:
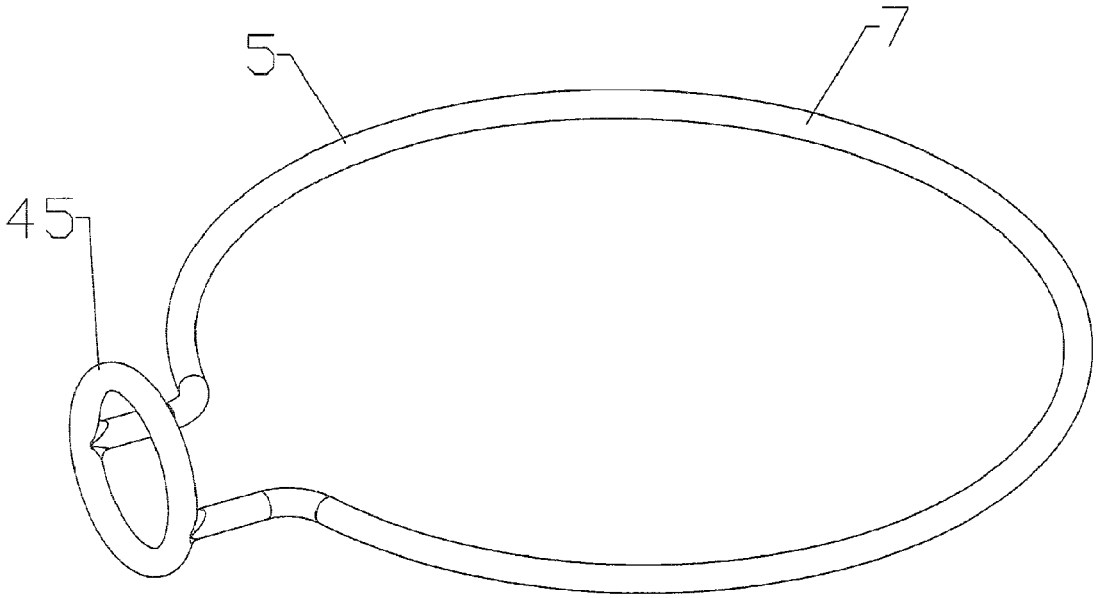
FIG. 5 is a schematic isometric view of a second exemplary embodiment of a sealing gasket according to the invention.

One skilled in the art will appreciate that the invention similarly applies to a sealing gasket configuration for any waveguide assembly 30 having any number of different input and or output port(s) 35, 40 intersecting with a first plane that divides first and second portions of the waveguide assembly 30. For example, as shown in FIG. 5, like elements notated according to the description with respect to the first exemplary embodiment hereinabove, a single secondary loop 45 for an input or output port 35, 40 may intersect with the first plane, other ports which may be present having interconnections and separate sealing gaskets that do not intersect with the first plane.

Although the secondary loop(s) 45 have been demonstrated in the present exemplary embodiments as each bisected by the primary sealing surface loop, depending upon the arrangement of the waveguide feature(s) 15 between the first portion 20 and the second portion 25 and or the desired port configuration, the intersection may appear at any two points along the secondary loop 45. Also, the primary sealing surface loop 7 of the first plane may have any circumferential configuration depending upon the dimensions and layout of the applicable waveguide assembly 30 (not shown).

Table of Parts

| | |
|---|---|
| 5 | sealing gasket |
| 7 | primary sealing surface loop |
| 10 | sealing groove |
| 15 | waveguide feature |
| 20 | first portion |
| 25 | second portion |
| 30 | waveguide assembly |
| 35 | input port |
| 40 | output port |
| 45 | secondary loop |

Where in the foregoing description reference has been made to ratios, integers, components or modules having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

What is claimed is:

1. A sealing gasket for a waveguide assembly, comprising:

a primary sealing surface loop defining a first plane;

a secondary loop defining a second plane;

the primary sealing surface loop intersecting with and being broken by the secondary loop at two locations around the secondary loop.

2. The sealing gasket of claim 1, wherein the primary sealing surface loop bisects the secondary loop.

3. The sealing gasket of claim 1, wherein the first plane and the second plane are aligned normal to each other.

4. The sealing gasket of claim 1, further including an additional loop defining a third plane;

the primary sealing surface loop intersecting with the additional loop in the third plane at two locations around the additional loop in the third plane.

5. The sealing gasket of claim 1, wherein the intersection between the primary sealing surface loop and the secondary loop enters the second plane within a diameter of the secondary loop and then connects to the secondary loop.

6. The sealing gasket of claim 1, further including an additional secondary loop in the second plane, also intersected by the primary sealing surface loop at two locations around the additional secondary loop.

7. A waveguide assembly, comprising:

a first portion and a second portion adapted to mate together along a first plane; the first portion and the second portion enclosing waveguide feature(s) between the first portion and the second portion;

an input port located at a peripheral edge of the first and second portions is coupled to the waveguide features, a cross section of the input port at the edge defining a second plane;

a sealing groove in at least one of the first portion and the second portion, along the first plane, circumferentially surrounds the waveguide features and intersects the second plane at two positions; between the two positions, the sealing groove circumferentially loops around the input port in the second plane;

a unitary sealing gasket is positioned in the sealing groove, surrounding the waveguide features in the first plane and the input port in the second plane.

8. The waveguide assembly of claim 7, further including an output port located at the peripheral edge of the first and second portion(s) is coupled to the waveguide features, a cross section of the output port at the edge defining a third plane;

the sealing groove and sealing gasket intersecting the third plane at two locations and circumferentially looping around the output port in the third plane.

9. The waveguide assembly of claim 7, wherein a further input port is provided in the second plane, the sealing groove and the sealing gasket circumferentially looping around each of the input port(s) in the second plane.

* * * * *